US012320566B2

(12) United States Patent
Gerson et al.

(10) Patent No.: US 12,320,566 B2
(45) Date of Patent: Jun. 3, 2025

(54) SUCTION GAS HEAT EXCHANGER CONTROL AND UTILIZATION

(71) Applicant: TRANE INTERNATIONAL INC., Davidson, NC (US)

(72) Inventors: Thibaut Gerson, Nancy (FR); Raphael Gury, Thaon les Vosges (FR); Jon P. Hartfield, La Crosse, WI (US); Laurent Maire Richard, Charmes (FR); Patrick Alexandre, Gézoncourt (FR); Sebastien Montemont, Charmes (FR); Thierry Choffe, Charmes (FR)

(73) Assignee: TRANE INTERNATIONAL INC., Davidson, NC (US)

( * ) Notice: Subject to any disclaimer, the term of this patent is extended or adjusted under 35 U.S.C. 154(b) by 68 days.

(21) Appl. No.: 17/854,957

(22) Filed: Jun. 30, 2022

(65) Prior Publication Data

US 2024/0003603 A1 Jan. 4, 2024

(51) Int. Cl.

| | |
|---|---|
| ***F25B 41/20*** | (2021.01) |
| ***F25B 40/02*** | (2006.01) |
| ***F25B 41/40*** | (2021.01) |
| ***F25B 43/02*** | (2006.01) |
| ***F25B 49/02*** | (2006.01) |

(52) U.S. Cl.

CPC ..... *F25B 43/02* (2013.01); *F25B 40/02* (2013.01); *F25B 41/20* (2021.01); *F25B 41/40* (2021.01); *F25B 49/02* (2013.01); *F25B 2313/031* (2013.01)

(58) Field of Classification Search

CPC ..... F25B 43/02; F25B 41/20; F25B 41/40; F25B 40/02; F25B 49/02; F25B 2313/031

See application file for complete search history.

(56) References Cited

U.S. PATENT DOCUMENTS

| | | | | |
|---|---|---|---|---|
| 6,058,727 | A | 5/2000 | Fraser, Jr. et al. | |
| 6,457,325 | B1 | 10/2002 | Vetter | |
| 2012/0012768 | A1* | 1/2012 | Yahr | F16K 11/065 251/129.11 |

(Continued)

FOREIGN PATENT DOCUMENTS

WO WO-2020113152 A2 * 6/2020 ..... B60H 1/3214

OTHER PUBLICATIONS

Dingel, Lubricant management for an hvacr system, 2019, Full Document (Year: 2019).*

(Continued)

*Primary Examiner* — Nael N Babaa

(74) *Attorney, Agent, or Firm* — HSML P.C.

(57) ABSTRACT

A heating, ventilation, air conditioning, and refrigeration (HVACR) system includes a suction heat exchanger configured to add heat to working fluid prior to entering the compressor, so as to support the generation of superheat by the HVACR system. The superheat can be controlled to achieve desired levels, so as to support the separation of lubricant from working fluid of the HVACR system. The suction heat exchanger can heat the working fluid passing to the suction of the compressor by exchanging heat with working fluid sourced from between the lubricant separator and the condenser. The suction heat exchanger can further be used as a receiver for controlling the charge of working fluid circulating in the HVACR system.

17 Claims, 4 Drawing Sheets

(56) References Cited

U.S. PATENT DOCUMENTS

| | | | | |
|---|---|---|---|---|
| 2014/0338867 | A1* | 11/2014 | Svensson | F28F 13/12 165/109.1 |
| 2021/0285693 | A1 | 9/2021 | Gerson | |
| 2022/0026115 | A1* | 1/2022 | Zha | F25B 41/20 |
| 2022/0275974 | A1* | 9/2022 | Liu | F25B 1/047 |

OTHER PUBLICATIONS

Extended European Search Report, European Patent Application No. 23182767.6, Oct. 30, 2023 (9 pages).

* cited by examiner

SUCTION GAS HEAT EXCHANGER CONTROL AND UTILIZATION

FIELD

This disclosure is directed to heating, ventilation, air conditioning, and refrigeration (HVACR) systems including a heat exchanger affecting temperature of suction gas.

BACKGROUND

Improvements to compressor efficiency result in the generation of less waste heat. Further, working fluids such as low global warming potential (low-GWP) working fluids often are soluble with oil used as lubricants in compressors. Combined, this can result in poor separation of working fluid and lubricant in some heating, ventilation, air conditioning, and refrigeration (HVACR) systems.

SUMMARY

This disclosure is directed to heating, ventilation, air conditioning, and refrigeration (HVACR) systems including a heat exchanger affecting temperature of suction gas.

By increasing the temperature of working fluid at suction of a compressor of an HVACR system, a discharge superheat can in turn be increased. The increased discharge superheat can improve separation of lubricants from working fluids, even in systems using low global warming potential (low-GWP) working fluids.

The suction heat exchanger can further be used to store a portion of the working fluid charge of the HVACR system, operating as a dynamic receiver allowing control of the charge of working fluid circulating in the HVACR system, further improving performance of the HVACR system by tailoring the charge to current operating conditions.

In an embodiment, a heating, ventilation, air conditioning, and refrigeration (HVACR) system includes a circuit. The circuit includes a compressor having a suction and a discharge, a condenser, an expander, an evaporator, a lubricant separator located downstream of the discharge of the compressor and upstream of the condenser, and a heat exchanger located between the evaporator and the suction of the compressor. The HVACR system also includes a source line configured to direct a flow of refrigerant from the circuit to the heat exchanger. The source line is connected to the circuit between the lubricant separator and the condenser. The HVACR system further includes a return line configured to direct the flow of refrigerant from the heat exchanger to the circuit. The return line is connected to the circuit between the condenser and the evaporator.

In an embodiment, the HVACR system further includes a valve configured to control the flow of refrigerant in one of the source line or the return line. In an embodiment, the valve is a stepper valve.

In an embodiment, the return line is connected to the circuit between the expander and the evaporator.

In an embodiment, the return line is connected to the circuit between the condenser and the expander.

In an embodiment, the circuit further includes a subcooler positioned between the condenser and the expander, and the return line is connected to the circuit between the subcooler and the expander.

In an embodiment, the HVACR system further includes a temperature and/or pressure sensor located between the heat exchanger and the suction of the compressor.

In an embodiment, the HVACR system further includes a temperature and/or pressure sensor located between the discharge of the compressor and the lubricant separator.

In an embodiment, the heat exchanger is a shell-and-tube heat exchanger.

In an embodiment, a method of operating a HVACR system includes directing a working fluid through a circuit including a lubricant separator, a condenser, an expander, and an evaporator and heating the working fluid leaving the evaporator prior to the working fluid entering a suction of a compressor connected to the circuit. Heating the working fluid includes exchanging heat between the working fluid leaving the evaporator and a flow of the working fluid obtained from the circuit between the lubricant separator and the condenser at a heat exchanger.

In an embodiment, heating the working fluid increases a discharge superheat of the compressor.

In an embodiment, the method further includes separating lubricant from the working fluid at the lubricant separator.

In an embodiment, the method further includes controlling a quantity of the flow of the working fluid using a controllable valve.

In an embodiment, the method further includes measuring a temperature and/or pressure using a sensor located between the heat exchanger and the suction of the compressor, and controlling the controllable valve based on the measured temperature and/or pressure. In an embodiment, the method further includes measuring a temperature and/or pressure using a sensor located between a discharge of the compressor and the lubricant separator, and controlling the controllable valve based on the measured temperature and/or pressure.

In an embodiment, the method further includes controlling a quantity of working fluid in the circuit by retaining at least a portion of the flow of the working fluid within the heat exchanger.

DRAWINGS

DETAILED DESCRIPTION

This disclosure is directed to heating, ventilation, air conditioning, and refrigeration (HVACR) systems including a heat exchanger affecting temperature of suction gas.

Figure 1:
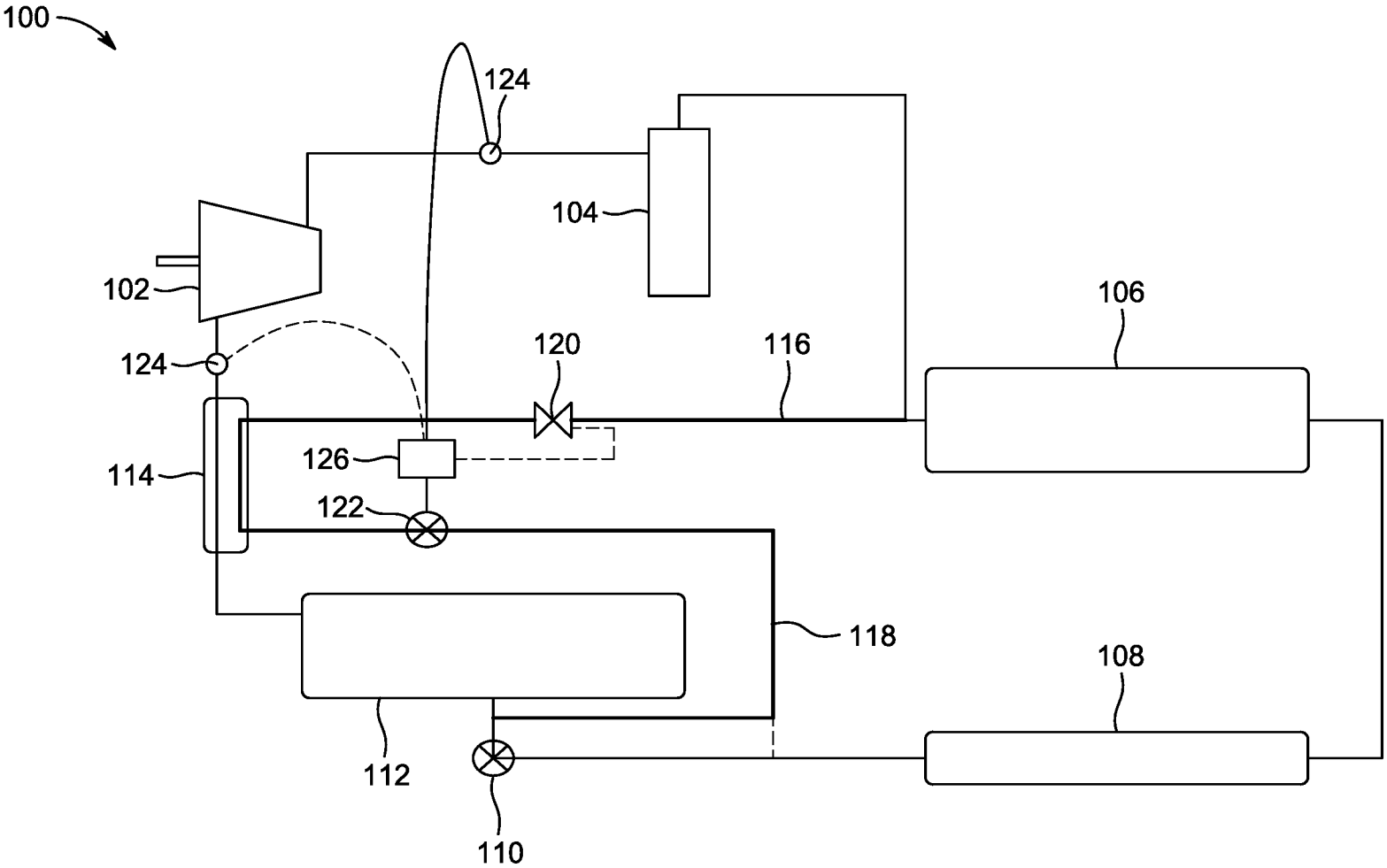
FIG. 1 shows a circuit of a heating, ventilation, air conditioning, and refrigeration (HVACR) system according to an embodiment.

FIG. 1 shows a circuit of a heating, ventilation, air conditioning, and refrigeration (HVACR) system 100 according to an embodiment. HVACR system 100 includes compressor 102, lubricant separator 104, condenser 106, subcooler 108, expander 110, evaporator 112, and suction heat exchanger 114. Source line 116 and return line 118 are connected to the suction heat exchanger 114. The HVACR system 100 can further include a source valve 120 and/or a return valve 122. HVACR system 100 can further include sensor 124 and a controller 126.

HVACR system 100 can circulate a working fluid. The working fluid can be a refrigerant. The working fluid can be any suitable working fluid, with non-limiting examples including low global warming potential (low-GWP) refrigerants such as R1234ze, R515, blends including such working fluids, and the like. In an embodiment, the working fluid is a working fluid having a relatively high solubility with one or more lubricants used in the HVACR system 100. In an embodiment, the compressor 102 can be one or more compressors 102. The compressors 102 can be any one or more suitable compressors for compressing a working fluid, such as screw compressors, scroll compressors, or the like. Where multiple compressors 102 are included in the HVACR system 100, the compressors can be in parallel with one another. The one or more compressors 102 discharge compressed working fluid into a discharge line conveying the discharge towards lubricant separator. In an embodiment, the one or more compressors 102 can be one to four compressors.

Lubricant separator 104 is located downstream of the discharge of the one or more compressors 102. Lubricant separator 104 receives the discharge of at least one of the one or more compressors 102 and removes lubricant from the discharge, allowing working fluid to pass on to condenser 106 while the lubricant that is recovered can be conferred to a retention location such as a sump, returned to a bearing of compressor(s) 102, or the like. Lubricant separator 104 can be any suitable lubricant separator for separating lubricant from working fluid used in the HVACR system 100. An operational effectiveness of the lubricant separator 104, for example, the fraction of lubricant remaining in working fluid exiting the lubricant separator 104, can be influenced by properties of the discharge flow such as the discharge superheat of the flow from the one or more compressors 102 to the lubricant separator 104. A desired discharge superheat can be determined at least in part based on the operational effectiveness of the lubricant separator 104.

Condenser 106 is a heat exchanger configured to receive relatively hot working fluid, where the working fluid can reject heat to another medium, such as ambient air, a flow of water, or any other suitable medium for absorbing heat from the working fluid.

Subcooler 108 can optionally be included in HVACR system 100. Subcooler 108 is configured to further cool the working fluid from condenser 106. The cooling at subcooler 108 can bring the working fluid to or below a saturation condensing temperature of the working fluid. Subcooler 108 can increase a fraction of the working fluid that is in a liquid phase. In an embodiment, subcooler 108 can ensure that the working fluid is completely in a liquid phase prior to expander 110. In an embodiment, subcooler 108 is a heat exchanger separate from condenser 106. In an embodiment, subcooler 108 can be a section of condenser 106.

Expander 110 is downstream of condenser 106 or subcooler 108. Expander 110 is configured to expand the working fluid received from condenser 106 or subcooler 108. Expander 110 can be any suitable expander for the working fluid, such as an expansion valve, an expansion plate, an expansion vessel, one or more expansion orifices, or any other known suitable structure for expanding the working fluid. In an embodiment, the expander 110 is a controllable expander, such as an electronic expansion valve or the like.

Evaporator 112 is downstream of the expander 110. Evaporator 112 is configured to exchange heat between the working fluid following its expansion at expander 110 and a process fluid, such as water to be chilled, air to be cooled for distribution to a conditioned space, or any other such suitable process fluid for the HVACR system 100.

Suction heat exchanger 114 is a heat exchanger configured to exchange heat between working fluid leaving the evaporator 112 and relatively hot working fluid sourced from between the lubricant separator 104 and the condenser 106. The suction heat exchanger 114 can be a shell-and-tube heat exchanger. In an embodiment, the working fluid leaving evaporator 112 can be on a tube side of the suction heat exchanger 114. The suction heat exchanger 114 is configured such that heat is added to the working fluid leaving the evaporator 112 prior to its return to the one or more compressors 102. The heat added to the working fluid at suction heat exchanger 114 results in working fluid having greater superheat when it is discharged from the compressor(s) 102, thus having an increased discharge superheat. The suction heat exchanger 114 can be controlled to control the addition of heat to the working fluid leaving evaporator 112, for example such that more heat is added when the compressor is at a condition associated with a low discharge superheat for the compressor(s) 102.

The working fluid obtained from between the lubricant separator 104 and the condenser 106 is conveyed to the suction heat exchanger 114 by source line 116. Source line 116 can optionally include a source valve 120. Source valve 120 can be any suitable valve for controlling flow into or through source line 116. In an embodiment, source valve 120 is a controllable valve having a plurality of flow rates that can be provided, or capable of providing any flow rate within a defined range of flow rates. In an embodiment, the source valve 120 is a stepper valve. Source valve 120 can be operated by controller 126. In an embodiment, source valve 120 can be controlled based on a heat to be added to the working fluid passing through suction heat exchanger 114 to the compressor(s) 102. When suction heat exchanger 114 is a shell-and-tube heat exchanger, source line 116 can be connected to the shell side of the heat exchanger. Source valve 120 can be at a beginning or end of, or along source line 116. In an embodiment, source valve 120 can be included as an alternative to the inclusion of return valve 122. In an embodiment, where source valve 120 is included, the return line 118 can connect to as a point between condenser 106 and expander 110.

Return line 118 is configured to return working fluid from the suction heat exchanger 114 to the fluid circuit including the condenser 106, subcooler 108, expander 110, and evaporator 112. In the embodiment shown in FIG. 1, the return line 118 is configured to return the working fluid to the fluid circuit at one of a point between expander 110 and evaporator 112, or as an alternative option, at a point between condenser 106 and expander 110. When suction heat exchanger 114 is a shell-and-tube heat exchanger, return line 118 is connected to a shell side of the suction heat exchanger 114. Flow through return line 118 can be controlled by a return valve 122. Return valve 122 can be used to control an amount of flow through suction heat exchanger so as to control the effect of the suction heat exchanger 114 on flow to the suction of the compressor(s) 102. Return valve 122 can be a controllable valve. In an embodiment, return valve 122 is an expansion valve, such as an electronic expansion valve. In an embodiment, return valve 122 can be configured such that a flow rate can be controlled, for example having a plurality of possible flow rate settings. Return valve 122 can be at a beginning or end of, or along return line 118. Return valve 122 can be controlled by the controller 126. In an embodiment, return valve 122 can be controlled at least in part based on a desired quantity of working fluid circulating through HVACR system 100. Control of return valve 122 can allow the suction heat exchanger 114 to be used as a receiver for storing working fluid and thus controlling the charge of working fluid circulating in HVACR system 100. The return valve 122 can additionally or alternatively be controlled to at least partially control the conditions at suction heat exchanger 114 to control the amount of heat added to working fluid at said suction heat exchanger 114.

Figure 2:
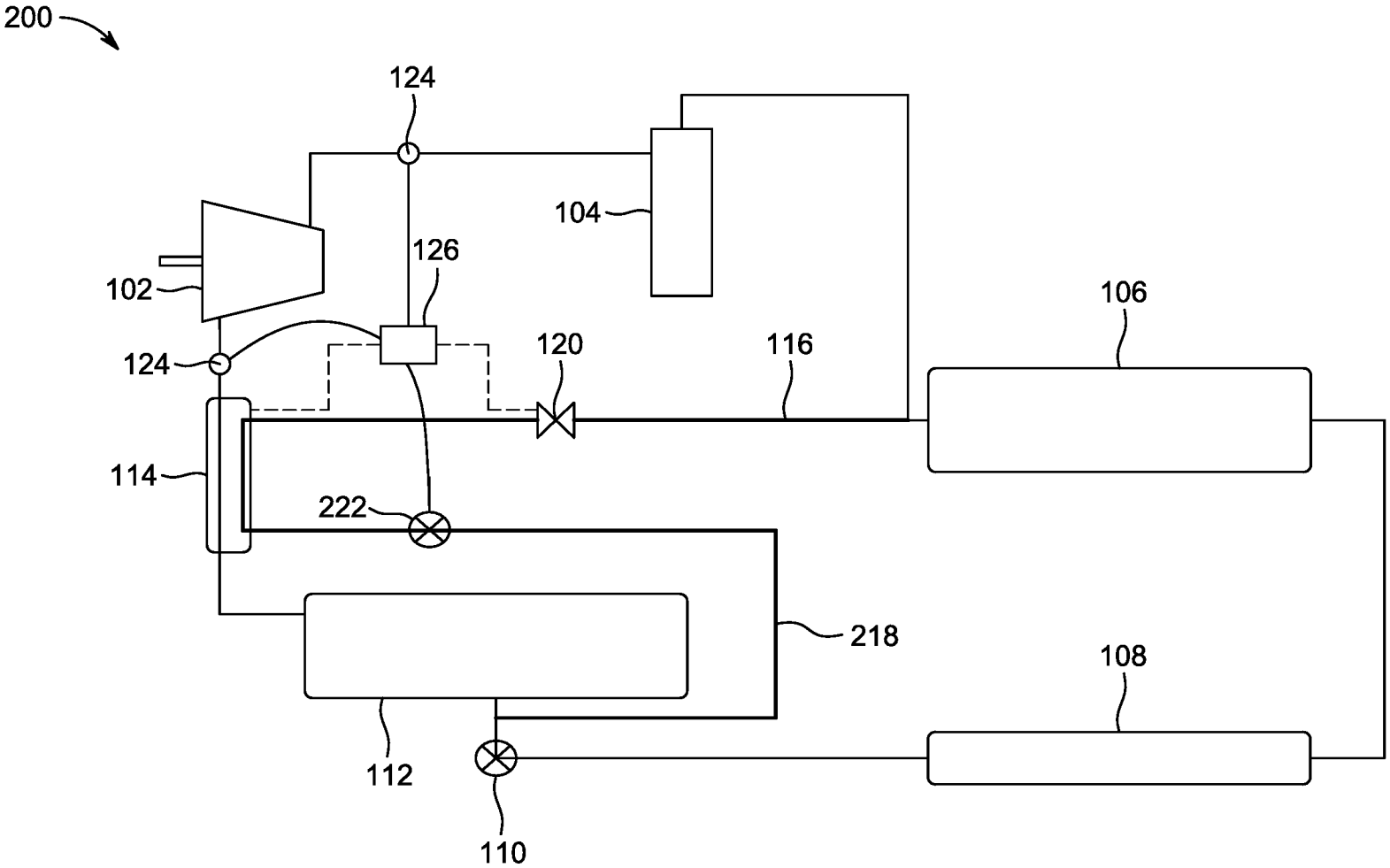
FIG. 2 shows a circuit of an HVACR system according to an embodiment.

Sensors 124 can be positioned along the fluid line conveying working fluid from suction heat exchanger 114 to the suction of the compressor(s) 102 and/or along the fluid line conveying working fluid from the discharge of the compressor(s) 102 to lubricant separator 104. In some embodiments, one of the sensors 124 as shown in FIG. 2 can be omitted, with the other sensor 124 providing data to the controller 126. Sensor 124 includes a temperature sensor and optionally a pressure sensor configured to detect the temperature and optionally the pressure of the working fluid. The sensors 124 can be used to determine the superheat at suction of the compressor(s) 102 and/or the superheat at the discharge of the compressor(s) 102. The superheat data captured by the sensors 124 can be used by controller 126 to control the suction heat exchanger 114 so as to achieve a desired discharge superheat for HVACR system 100. In an embodiment, the sensor 124 provided along the fluid line conveying working fluid from suction heat exchanger 114 to the suction of the compressor(s) 102 can be used to get a measurement indicative of the response to changes to the operation of suction heat exchanger 114 without requiring a time lag based on the time for the working fluid to be passed through the compressor, thus providing superheat data more responsive to control of the suction heat exchanger 114. The sensor 124 provided on the fluid line conveying working fluid from the discharge of the compressor(s) 102 to lubricant separator 104 can provide a direct measurement of discharge superheat, which is the value for which a target value is pursued to improve the separation of lubricant from working fluid at the lubricant separator 104. The sensor 124 can be connected to controller 126. Measurements from sensor 124 can be used to determine a resulting discharge superheat of the compressor(s) 102, for example at controller 126.

Controller 126 is configured to control the HVACR system 100. Controller 126 can be configured to particularly control suction heat exchanger 114, source valve 120, return valve 122, and optionally also control other components of the HVACR system 100 such as the compressor(s) 102, the expander 110, and the like. Controller 126 can be configured to control a discharge superheat of the compressor(s) 102, for example by controlling the heat added to working fluid through heat exchange relationship with the suction heat exchanger 114. In an embodiment, controller 126 can control the heat added to the working fluid at suction heat exchanger 114 by controlling an amount of working fluid passing through the source valve 120 and/or the return valve 122. In an embodiment, controller 126 can control the use of suction heat exchanger 114 as a receiver to control the charge of working fluid circulating through HVACR system 100. The controller 126 can, for example, control return valve 122 to control an amount of fluid returning from suction heat exchanger 114 to circulate in HVACR system 100. The controller 126 can control the flow through return valve 122 based on any suitable factors for controlling the charge of working fluid circulating in HVACR system 100, such as current operating conditions of the HVACR system 100, suction or discharge temperatures, pressures, or superheat values, or the like.

FIG. 2 shows a circuit of an HVACR system according to an embodiment. HVACR system 200 includes compressor(s) 102, lubricant separator 104, condenser 106, optional subcooler 108, expander 110, evaporator 112, suction heat exchanger 114, source line 116, source valve 120, sensor 124 and controller 126 as described above and shown in FIG. 1. In HVACR system 200, return line 218 extends from the suction heat exchanger 114 to join the circuit of HVACR system 200 between the expander 110 and evaporator 112, downstream of the expander 110. Return valve 222 is disposed at a beginning of, at an end of, or along the return line 218. Sensors 124 are included along each of the fluid line conveying working fluid from suction heat exchanger 114 to the suction of the compressor(s) 102 and the fluid line conveying working fluid from the discharge of the compressor(s) 102 to lubricant separator 104.

Figure 3:
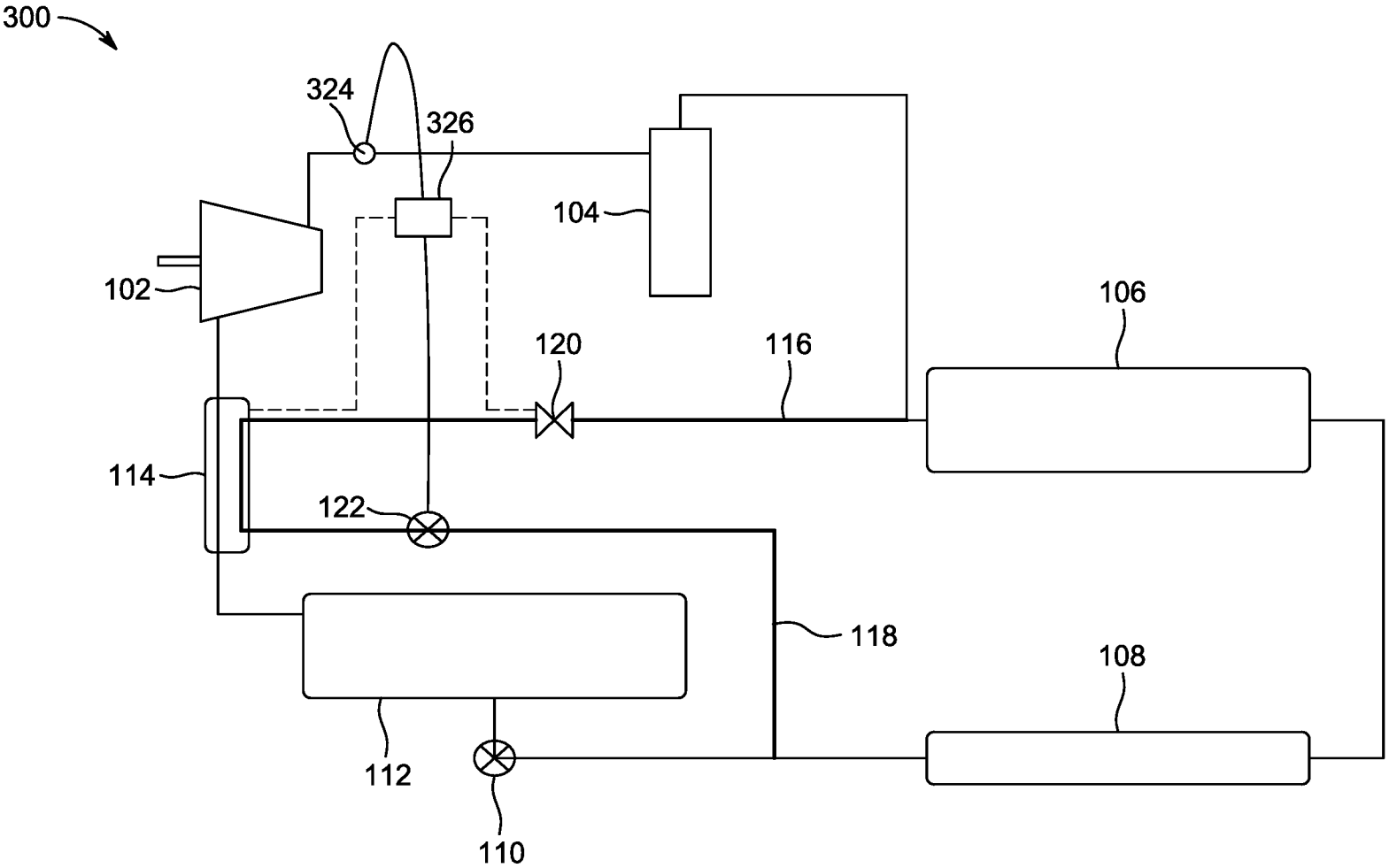
FIG. 3 shows a circuit of an HVACR system according to an embodiment.

FIG. 3 shows a circuit of an HVACR system according to an embodiment. HVACR system 300 includes compressor(s) 102, lubricant separator 104, condenser 106, optional subcooler 108, expander 110, condenser 112, suction heat exchanger 114, source line 116, return line 118, source valve 120 and/or return valve 122 as described above and shown in FIG. 1. HVACR system 300 can further include sensor 324 and a controller 326. Sensor 324 is located between the compressor(s) 102 and lubricant separator 104, for example at a discharge of a compressor 102, along a fluid line from the compressor(s) 102 to the lubricant separator 104, or at an inlet of the lubricant separator 104. The sensor 324 can include temperature and/or pressure sensors so as to determine a discharge superheat of the compressor(s) 102. The controller 326 is configured to control the source valve 120, suction heat exchanger 114, and/or return valve 122 based on the suction superheat determined based on data obtained by the sensor 324.

Figure 4:
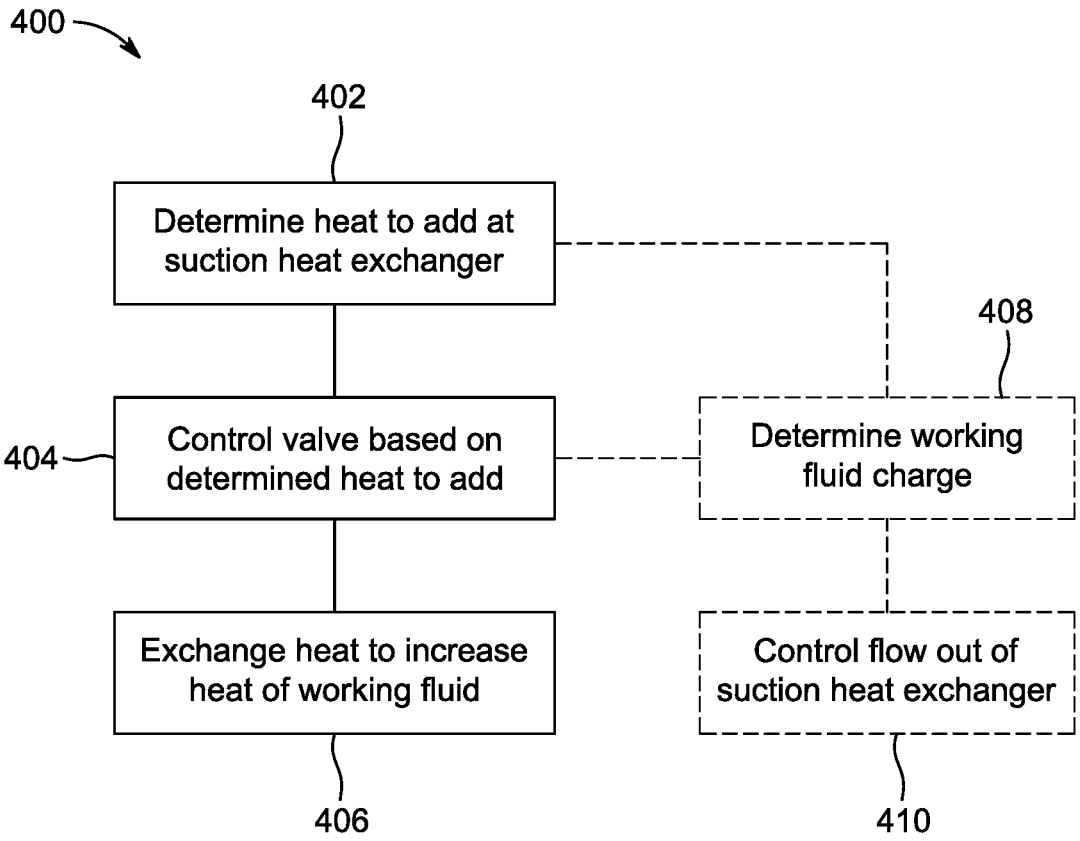
FIG. 4 shows a flowchart of operation of an HVACR system according to an embodiment.

FIG. 4 shows a flowchart of operation of an HVACR system according to an embodiment. Method 400 includes determining heat to add at a suction heat exchanger 402, controlling a first valve based on the heat to add 404, exchanging heat at the suction heat exchanger to increase a heat of working fluid 406. The method 400 can optionally further include determining a working fluid charge for the HVACR system 408 and controlling flow out of the suction heat exchanger based on the working fluid charge 410. Method 400 can be applied to any of the HVACR systems shown in FIGS. 1-3 and described herein.

A heat to add at the suction heat exchanger is determined at 402. The heat to add can be determined based on a desired superheat and a superheat contributed by the compressor of the HVACR system. The heat to add at the suction heat exchanger can be selected such that the heat added by the suction heat exchanger and the superheat contributed by the compressor meet or exceed the desired superheat. The desired superheat can be a target value for superheat to achieve separation of lubricant from working fluid at a lubricant separator of the HVACR system. In an embodiment, the desired superheat value can be approximately 5° C., which can be higher or lower depending on an operating condition of the system and/or the selection of working fluids used therein.

A first valve is controlled at 404 based on the determined heat to add at the suction heat exchanger. The first valve can be any valve capable of controlling flow of relatively hot working fluid into, through, and/or out of the suction heat exchanger. In an embodiment, the first valve is a stepper valve. In an embodiment, the first valve is a discharge bypass valve. In an embodiment, the first valve is an electronic expansion valve. In an embodiment, the first valve is a source valve such as source valve 120 shown in FIG. 1 and discussed above. In an embodiment, the first valve is a return valve such as return valve 122 shown in FIG. 1 and discussed above. The first valve is controlled such that the suction heat exchanger adds heat to working fluid passing from the evaporator to suction of the compressor, so as to meet the determined heat to add obtained in step 402 as described above.

Heat is exchanged at the suction heat exchanger to increase a heat of working fluid passing to the suction of the compressor at 406. The relatively hot fluid is sourced from a position between the lubricant separator and the condenser, and passes through the suction heat exchanger, being returned to the circuit of the HVACR system downstream of the condenser, for example between a subcooler (when present) and an expander of the HVACR system or between an expander and an evaporator of the HVACR system. The relatively cool fluid is fluid passing through the suction heat exchanger when flowing from the evaporator of the HVACR system to the suction of the compressor of the HVACR system. The relatively cool fluid absorbs heat from the relatively hot fluid, and thus has heat added prior to reaching the suction of the compressor. The heat added at 406 can be an amount based on the control of the first valve at 404, such that the HVACR system achieves the desired superheat by the addition of heat at the suction heat exchanger at 406 and the heat added by the operation of the compressor of the HVACR system.

In some embodiments, the suction heat exchanger can further be used to control a charge of working fluid circulating within the HVACR system. The suction heat exchanger can store at least some of the working fluid, varying the amount stored to control the charge of working fluid. In such embodiments, the method 400 can optionally further include determining a working fluid charge for the HVACR system 408. The charge can be determined according to any suitable method, for example based on the operating state of the HVACR system, measured system variables such as suction superheat, discharge superheat, or the like. In embodiments where method 400 includes determining a working fluid charge at 408, method 400 can optionally further include controlling flow out of the suction heat exchanger based on the working fluid charge 410. The flow out of the suction heat exchanger can be increased at 410 when the charge of working fluid circulating in the HVACR system is less than the charge determined at 408, adding the flow out of the suction heat exchanger to the circulating working fluid in the HVACR system. The flow out of the suction heat exchanger can be reduced or stopped at 410 when the charge of working fluid circulating in the HVACR system is greater than the charge determined at 408. Reducing or stopping flow out of the suction heat exchanger at 410 results in working fluid accumulating in the suction heat exchanger and thus being removed from circulation in the HVACR system, reducing the charge being circulated in the HVACR system.

Aspects

It is understood that any of aspects 1-9 can be combined with any of aspects 10-16.

Aspect 1. A heating, ventilation, air conditioning, and refrigeration (HVACR) system, comprising:

a circuit including:

a compressor having a suction and a discharge;

a condenser;

an expander;

an evaporator; and an lubricant separator located downstream of the discharge of the compressor and upstream of the condenser;

a heat exchanger located between the evaporator and the suction of the compressor;

a source line configured to direct a flow of refrigerant from the circuit to the heat exchanger, the source line connected to the circuit between the lubricant separator and the condenser; and a return line configured to direct the flow of refrigerant from the heat exchanger to the circuit, the return line connected to the circuit between the condenser and the evaporator.

Aspect 2. The HVACR system according to aspect 1, further comprising a valve configured to control the flow of refrigerant in one of the source line or the return line.

Aspect 3. The HVACR system according to aspect 2, wherein the valve is a stepper valve.

Aspect 4. The HVACR system according to any of aspects 1-3, wherein the return line is connected to the circuit between the expander and the evaporator.

Aspect 5. The HVACR system according to any of aspects 1-4, wherein the return line is connected to the circuit between the condenser and the expander.

Aspect 6. The HVACR system according to any of aspects 1-5, wherein the circuit further comprises a subcooler positioned between the condenser and the expander, and the return line is connected to the circuit between the subcooler and the expander.

Aspect 7. The HVACR system according to any of aspects 1-6, further comprising a temperature and/or pressure sensor located between the heat exchanger and the suction of the compressor.

Aspect 8. The HVACR system according to any of aspects 1-7, further comprising a temperature and/or pressure sensor located between the discharge of the compressor and the lubricant separator.

Aspect 9. The HVACR system according to any of aspects 1-8, wherein the heat exchanger is a shell-and-tube heat exchanger.

Aspect 10. A method of operating an HVACR system, comprising:

directing a working fluid through a circuit including a lubricant separator, a condenser, an expander, and an evaporator;

heating the working fluid leaving the evaporator prior to the working fluid entering a suction of a compressor connected to the circuit, wherein heating the working fluid includes exchanging heat between the working fluid leaving the evaporator and a flow of the working fluid obtained from the circuit between the lubricant separator and the condenser at a heat exchanger.

Aspect 11. The method according to aspect 10, wherein heating the working fluid increases a discharge superheat of the compressor.

Aspect 12. The method according to aspect 10 or 11, further comprising separating lubricant from the working fluid at the lubricant separator.

Aspect 13. The method according to any of aspects 10-12, further comprising controlling a quantity of the flow of the working fluid using a controllable valve.

Aspect 14. The method according to aspect 13, further comprising measuring a temperature and/or pressure using a sensor located between the heat exchanger and the suction of the compressor, and controlling the controllable valve based on the measured temperature and/or pressure.

Aspect 15. The method according to aspect 13 or 14, further comprising measuring a temperature and/or pressure using a sensor located between a discharge of the compressor and the lubricant separator, and controlling the controllable valve based on the measured temperature and/or pressure.

Aspect 16. The method according to any of aspects 10-15, further comprising controlling a quantity of working fluid in the circuit by retaining at least a portion of the flow of the working fluid within the heat exchanger.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The inventon claimed is:

1. A heating, ventilation, air conditioning, and refrigeration (HVACR) system, comprising:

a circuit including:

a compressor having a suction and a discharge;

a condenser;

an expander;

an evaporator; and a lubricant separator located downstream of the discharge of the compressor and upstream of the condenser;

a temperature sensor configured to measure a temperature of working fluid in the circuit;

a heat exchanger located between the evaporator and the suction of the compressor;

a source line configured to direct a flow of the working fluid from the circuit to the heat exchanger, the source line connected to the circuit between the lubricant separator and the condenser;

a return line configured to direct the flow of the working fluid from the heat exchanger to the circuit, the return line connected to the circuit between the condenser and the evaporator; and a valve configured to control the flow of the working fluid in the return line based on the temperature measured by the temperature sensor and a target superheat of the working fluid discharged from the compressor.

2. The HVACR system of claim 1, wherein the valve is a stepper valve.

3. The HVACR system of claim 1, wherein the return line is connected to the circuit between the expander and the evaporator.

4. The HVACR system of claim 1, wherein the return line is connected to the circuit between the condenser and the expander.

5. A heating, ventilation, air conditioning, and refrigeration (HVACR) system, comprising:

a circuit including:

a compressor having a suction and a discharge;

a condenser;

an expander;

an evaporator; and a lubricant separator located downstream of the discharge of the compressor and upstream of the condenser;

a heat exchanger located between the evaporator and the suction of the compressor;

a source line configured to direct a flow of working fluid from the circuit to the heat exchanger, the source line connected to the circuit between the lubricant separator and the condenser; and a return line configured to direct the flow of the working fluid from the heat exchanger to the circuit, the return line connected to the circuit between the condenser and the evaporator, wherein the circuit further comprises a subcooler positioned between the condenser and the expander, and the return line is connected to the circuit between the subcooler and the expander.

6. The HVACR system of claim 1, wherein the temperature sensor is located between the heat exchanger and the lubricant separator.

7. The HVACR system of claim 1, further comprising a pressure sensor located between the heat exchanger and the lubricant separator.

8. The HVACR system of claim 1, wherein the heat exchanger is a shell-and-tube heat exchanger.

9. A method of operating an HVACR system, comprising:

directing a working fluid through a circuit including a lubricant separator, a condenser, an expander, and an evaporator;

heating the working fluid leaving the evaporator prior to the working fluid entering a suction of a compressor connected to the circuit;

measuring, with a temperature sensor, a temperature of the working fluid in the circuit, wherein heating the working fluid includes exchanging heat between the working fluid leaving the evaporator and a flow of the working fluid obtained from the circuit between the lubricant separator and the condenser at a heat exchanger, and the flow of the working fluid obtained from the circuit is returned to the circuit by a return line, the method further comprising controlling, using a valve, the flow of the working fluid in the return line based on the measured temperature and a target superheat of the working fluid discharged from the compressor.

10. The method of claim 9, wherein heating the working fluid increases a discharge superheat of the compressor.

11. The method of claim 9, further comprising separating lubricant from the working fluid at the lubricant separator.

12. The method of claim 9, wherein the temperature sensor is located between the heat exchanger and the lubricant separator.

13. The method of claim 9, further comprising measuring a pressure of the working fluid using a sensor located between the heat exchanger and the lubricant separator, and controlling the valve based on the measured temperature, the measured pressure, and the target superheat of the working fluid discharged from the compressor.

14. The method of claim 9, further comprising controlling a quantity of the working fluid in the circuit by retaining at least a portion of the flow of the working fluid within the heat exchanger.

15. The HVACR system of claim 1, further comprising a controller configured to control the valve based on the measured temperature and the target superheat of the working fluid discharged from the compressor.

16. The HVACR system of claim 15, wherein the heat exchanger is configured to store the working fluid such that a quantity of the working fluid circulating through the HVACR system can be varied, and the controller is configured to control the valve based on a desired quantity of the working fluid circulating through HVACR system.

17. The HVACR system of claim 15, wherein the controller is configured to control the valve based on an amount of heat to be added to the working fluid at the heat exchanger.

* * * * *